US005140795A

United States Patent [19]

Steding

[11] Patent Number: 5,140,795

[45] Date of Patent: Aug. 25, 1992

[54] APPARATUS FOR SECURING OBJECTS TO A STORAGE PALLET AND WRAPPING ARM MECHANISM THEREFOR

[75] Inventor: Kurt L. Steding, Pittsburgh, Pa.

[73] Assignee: SDS, Inc., Pittsburgh, Pa.

[21] Appl. No.: 707,738

[22] Filed: May 30, 1991

[51] Int. Cl.[5] ..... B65B 13/04

[52] U.S. Cl. ..... 53/168; 53/556; 53/588; 53/210

[58] Field of Search ..... 53/168, 202, 556, 587, 53/588, 211, 210

[56] References Cited

U.S. PATENT DOCUMENTS

| | | | |
|---|---|---|---|
| 3,605,380 | 9/1971 | Dille | 53/202 |
| 3,930,442 | 1/1976 | Büttner . | |
| 3,948,018 | 4/1976 | Rowekamp | 53/202 X |
| 4,067,174 | 1/1978 | Goldstein | 53/556 |
| 4,109,445 | 8/1978 | Shulman . | |
| 4,282,700 | 8/1981 | Goldstein . | |
| 4,498,276 | 2/1985 | Reed . | |
| 4,545,182 | 10/1985 | McDowell, Jr. . | |
| 4,616,474 | 10/1986 | Morley et al. . | |
| 4,693,060 | 9/1987 | Born . | |
| 4,722,170 | 2/1988 | Ball et al. . | |
| 4,747,252 | 5/1988 | Kapke . | |
| 4,756,143 | 7/1988 | Lancaster . | |
| 4,761,934 | 8/1988 | Lancaster . | |
| 4,905,448 | 3/1990 | Plitt . | |
| 4,934,123 | 6/1990 | Salzsauler . | |
| 4,936,080 | 6/1990 | Haloila . | |
| 4,993,209 | 2/1991 | Haloila . | |

OTHER PUBLICATIONS

Infrapak Sidewinder brochure.
Infrapak E Z Wrapper brochure.
Lan-wrapper H-Series brochure.
Four (4) Lan-wrapper V-Series brochures.
T-Wrapper brochure.
Infrapak Spider borchure.

*Primary Examiner*—John Sipos
*Attorney, Agent, or Firm*—Barry I. Friedman

[57] ABSTRACT

An apparatus, which is utilized to secure loads to a number of pallets emanating from a plurality of sources, provides a relatively short, straight pathway from the point of construction of a loaded pallet to the wrapping station. The device further provides a plurality of stations to permit maximum utilization of a single wrapping apparatus. An improved swing arm is utilized to mount the stretch wrap on the stacked pallet and permits increased efficiency in pre-stretching and wrapping of the stacked loads. The wrapping apparatus is mounted at the end of a series of pallet conveyors. Each pallet transportation conveyor terminates in a wrapping station which is collinear with the other wrapping stations. A support beam extends longitudinally along the line of wrapping stations at a pre-selected height thereabove. A rolling transport is mounted upon wheels and rolls along the length of the beam. The transport contains the operating controls of the device as well as the swing arm which wraps the stacked pallets. The transport is adapted to move longitudinally along the support beam without interfering with the stacked pallets waiting at the wrapped stations. The swing arm is adapted to rotate in a circular motion from a pivot on a transport once the transport has moved into position at one of the plurality of wrapping stations. The swing arm encircles the waiting pallet at the wrapping station and applies the layers of helically wrapped material to the stacked pallet. Simple operator controls are provided to permit an operator to select locations in their prioritized order for wrapping.

34 Claims, 7 Drawing Sheets

APPARATUS FOR SECURING OBJECTS TO A STORAGE PALLET AND WRAPPING ARM MECHANISM THEREFOR

BACKGROUND OF THE INVENTION

1. Field of the Invention

The present invention relates to an apparatus for securing boxes of merchandise to a wooden pallet through the use of a continuous stretch wrap layer applied to the exterior of the loaded pallet. The invention also relates to an improved rotating arm mechanism utilized with the apparatus to achieve a proper wrap. More specifically, the invention relates to a multi-station wrapping mechanism which utilizes a single wrapping mechanism to wrap pallets at more than one location and to travel along a beam between the stations.

2. Description of the Prior Art

Modern transportation methods of goods involve the packaging of discrete manufactured units within cardboard enclosures. These cardboard enclosures are frequently stacked on a wooden pallet in standard lot sizes for ease of transportation in large quantities. The pallets are adapted to be easily located and transported through use of a forklift and may furthermore may be transported along a conveyor. Because the palleted merchandise must be moved by mechanical means, often involving stopping, starting and changing directions, the palleted load must be secure upon the pallet A first method of securing the load is to stack the objects thereon in an interlocking pattern which maximizes the stability of the stacked load. The weight and location of the goods are evenly distributed on the pallet so that minimal shifting occurs during transportation. Furthermore the pallet pattern, as such stacking practices are called, is designed to prevent collapse of materials in the lower portion of the stack.

An additional method for securing the "palletized" materials to the pallet is to enclose the palletized stack in a plastic wrap or film. This is especially useful when all of the palletized materials are not of identical shape and size. A plastic stretch wrap is applied to the exterior of the pallet stack and continuously wrapped around the exterior of the stack to effectively form a solid cube of materials. Due to the weight and size of the now unitary structure mounted on the pallet, shifting is less likely to occur during transportation of the palletized merchandise. In order to apply the stretchable plastic wrap to the pallet, the wrap is pre-stretched to a specified limit, applied to the palletized stack of merchandise with a certain force, and allowed to shrink back against the exterior of the palletized stack, forming a tight enclosure around the stacked materials. The physical wrapping of the pallet stack usually involves a helical progression of wrap from top to bottom, or vice versa, in a repeated fashion until the stack has been adequately secured. Care must be taken that the wrap is applied with the proper amount of pre-stretch and tension, commonly known as force to the load, otherwise the stack may become unstable or the contents may be crushed by the force of the stretched film A number of devices have been proposed in the prior art to automatically perform this wrapping function. A representative sample of these devices are disclosed in Ball, et al., U.S. Pat. No. 4,722,170, issued Feb. 2, 1988; Salzsauler, U.S. Pat. No. 4,934,123, issued Jun. 19, 1990; and Haloila, U.S. Pat. No. 4,993,209, issued Feb. 19, 1991. Each of the references discloses a device which generally comprises a support stand having a rotating swing arm mounted thereon, and a swing arm having a carriage at the end thereof which contains the plastic wrap. The Haloila reference utilizes a fixed circular track surrounding the pallet having a carriage mounted thereupon, to achieve the same objective. The carriage containing the plastic wrap is continuously rotated in a circular fashion about the palletized stack which is helically encased in at least one layer of film while the carriage rotates thereabout while moving vertically along its support column.

Each of the previously described devices is stationary and permanently mounted within its operating environment. None of the previously mentioned three references describes the method by which the palletized materials are brought to the location of the wrapping device.

Buettner, U.S. Pat. No. 3,930,442, issued Jan. 6, 1976; Shulman, U.S. Pat. No. 4,109,445, issued Aug. 29, 1978; and Haloila, U.S. Pat. No. 4,936,080, issued Jun. 26, 1990, all disclose similar wrapping devices as those previously described. Each of these three references further discloses the use of a conveyor to transport the palletized goods to the wrapping station.

In practice, the cost and speed of these prior art devices necessitates the use of a single wrapping device in conjunction with a plurality of conveyor feed lines. In most packaging operations, a number of stacked pallets are prepared simultaneously and must be conveyed to the single wrapping device. Feed conveyor lines are utilized to transport the stacked pallet to the wrapping device. Since multiple feed lines are utilized, the feed lines must be sequentially combined into a single line leading to the wrapper. The complexity of this transportation system including changes in direction of the palletized material. Furthermore, the transportation of a stacked pallet from one feed line to another provides a great opportunity for the disintegration of the palletized load. This is especially prevalent when the palletized load comprises a large number of small boxes or boxes of varying size and weight. In such a stack, the lightest, smallest boxes are placed at the top of the palletized stack and are more likely to be lost or damaged during transportation of the stack on the conveyors.

What is lacking in the art, therefore, is a device which minimizes the amount of transportation distance between the palletizing of the goods and the wrapping thereof. Furthermore, a device is lacking in the art which minimizes the complex twists and turns a palletized load must undergo between the creation thereof and the wrapping by the wrapping apparatus.

SUMMARY OF THE INVENTION

An apparatus is disclosed which is utilized to secure loads to a number of pallets emanating from a plurality of sources while provide a relatively short, straight pathway from the point of construction of the loaded pallet to the wrapping station. The structure minimizes the amount and complexity of the travel path of the loaded pallet while the load stacked thereupon is unwrapped and therefore relatively unstable. The device further provides a plurality of stations to permit maximum utilization of the wrapping apparatus. The provision of multiple stations further permits a variety of different sized and shaped pallet patterns to be wrapped simultaneously as each pallet type may go to its own unique station. An improved swing arm, which is utilized to actually mount the stretch wrap on the stacked pallet, is also provided to permit increased efficiency in pre-stretching and wrapping of the various stacked loads. A high strength bearing structure, providing high radial and thrust load values, is utilized to permit high wrapping speeds and increased accuracy over currently available swing arms. The device is, however, also adapted to utilize commercially available swing arms.

The device is adapted to be the terminal station at the end of a palletizing operation. In this system, a plurality of feed conveyors terminate in a series of stacking pens. Within the stacking pens, the pallets are assembled within the enclosure. Each stacking pen resides at the beginning of a short, straight conveyor which will permit the transportation of the loaded pallet to the wrapping station. It is specifically intended that this transportation pathway be relatively short and without any turns or path direction changes to permit the stacked pallet to be transported without incident to its wrapping location.

The wrapping apparatus itself is mounted at the end of the pallet conveyors. Each pallet transportation conveyor terminates in a wrapping station which is collinear with the other wrapping stations. A support beam extends longitudinally along the line of wrapping stations at a pre-selected height thereabove. A rolling transport is mounted upon wheels and rolls along the length of the beam. The transport contains the operating controls for the device as well as the swing arm which will actually wrap the stacked pallets. The beam is supported at each end by a truss or stanchion in the preferred embodiment. It may, however, be mounted in any conventional manner, such that it is permanently fixed in position with relation to the wrapping stations. The transport is adapted to move longitudinally along the support beam without interfering with the stacked pallets waiting at the wrapping stations. During longitudinal movement of the transport, the swing arm is positioned in a home position which is out of the wrapping station line.

The swing arm is adapted to rotate in a circular motion from a pivot on the transport once the transport has moved into position at one of the plurality of wrapping stations. The swing arm encircles the waiting pallet at the wrapping station and applies the layers of wrapping material to the stacked pallet. Simple operator controls are provided to permit an operator to select the location of next priority for the transport whereupon the transport will automatically move to the position. Upon operator command, the arm will wrap the stacked pallet into a package according to pre-selected conditions assigned to that wrapping station. Once this is completed, the operator may select the wrapping station of next highest priority, and so on. Each wrapping station may have its own set of wrapping characteristics according to the needs of the wrapping facility.

An extra station may optionally be provided by which the stacked pallets are transported to the extra wrapping station by forklift or other manual means and not by conveyor.

Each station is provided with a locating means to permit the transport to sense its position along the support beam. The transport is rolled along a track by an electric motor and drive train. A braking apparatus is optionally provided for faster stopping ability. A sensing means is provided to determine the location of the transport mechanism while electrical and fluid communication is provided through lines strung along a communication rail above the support beam. These lines are mounted such as to reduce any interference of the lines with the moving transport. An interlock system is provided to prevent movement of the swing arm simultaneously with the movement of the transport mechanism.

The swing arm itself is shown in two embodiments, one incorporating the commercially available swing arm and the other utilizing a swing arm uniquely designed for this application. The swing arm is generally mounted on the transport mechanism at a pivot point and rotates in a manner generally perpendicular to the longitudinal axis of the support beam, encircling the pallet. A horizontal member is rotatably affixed to the transport while a vertical member extends downwardly therefrom, terminating in a wrapping carriage. The wrapping carriage contains the plastic wrap and the means by which the wrap is pre-stretched and applied. As the horizontal member rotates about the circumference of the pallet, the wrapping carriage is moved up and down along the length of the vertical member to produce the helical wrap around the stacked pallet. The improved swing arm further provides an improved pre-stretching mechanism to more efficiently apply the stretch wrap to the palletized load. Two electric drum motors are utilized to pre-stretch the material according to data acquired in an interactive fashion.

These and other advantages and features of the present invention will be more fully understood with reference to the presently preferred embodiments thereof and to the appended drawings.

DESCRIPTION OF THE PREFERRED EMBODIMENTS

Figure 1:
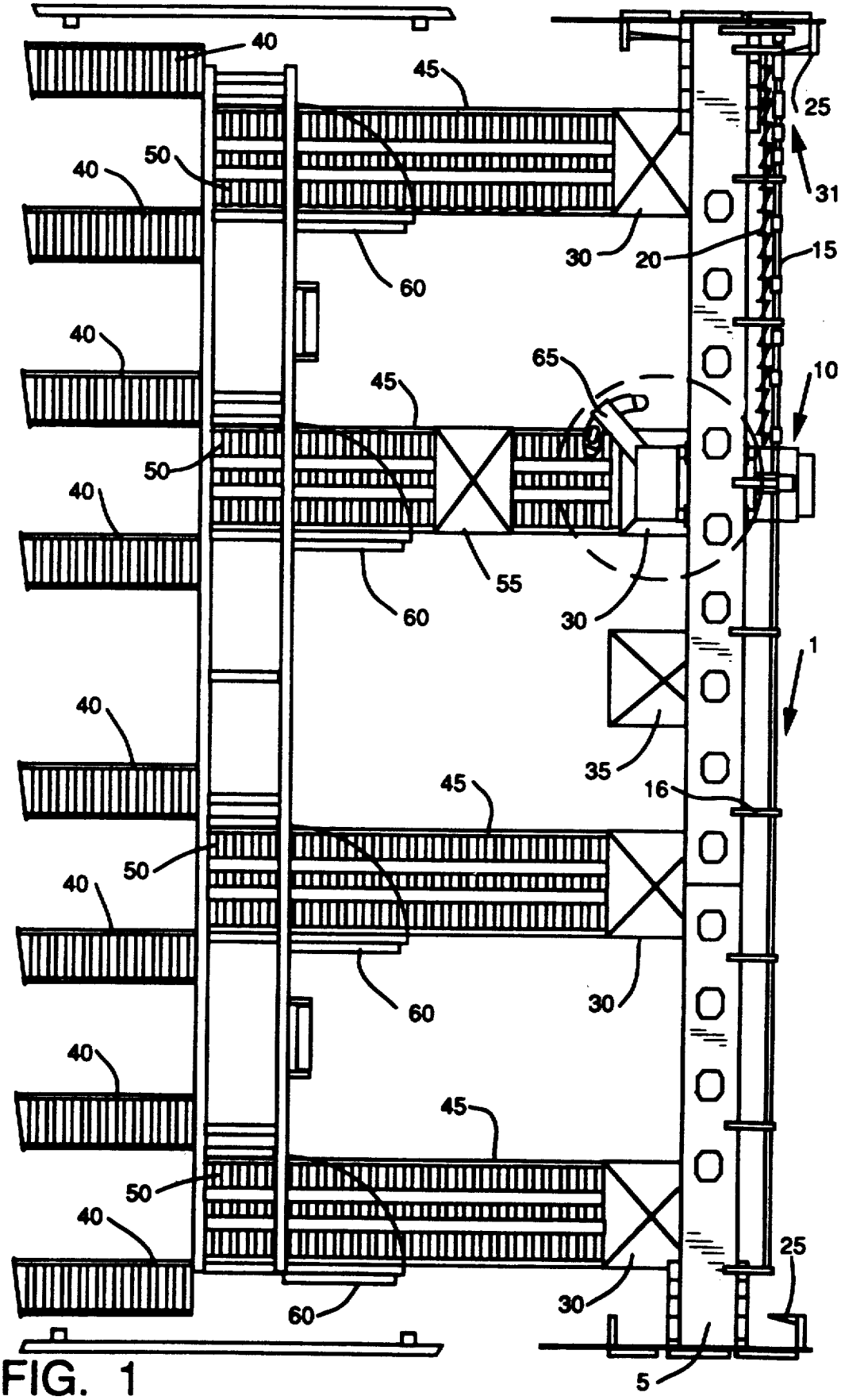
FIG. 1 is a top plan view of the wrapping mechanism including the feed conveyors, pallet construction pens and pallet conveyors.

As shown in FIG. 1, the wrapping mechanism 1 is illustrated with the associated pallet construction and transportation mechanism associated therewith. The wrapping mechanism 1 utilizes a support beam 5 suspended a pre-selected distance above the ground. The support beam 5 is utilized by transport 10 as a track to move in a longitudinal fashion suspended the pre-selected distance above the ground. Transport 10 may utilize either electronic or fluid apparatus or both, thereupon and communication line 20 is provided for either an electrical line or a hydraulic/pneumatic conduit or both. The communication line may be provided in a single line or in multiple lines and may be supported from a communication line support rail 15 having a plurality of sliding hangers mounted thereon. This will allow the communication lines to be suspended above the transport and support beam without interfering with the movement of the transport 10. Rail support members 16 are utilized to affix the communication line support rail 15 to the support beam 5. The entire support beam 5 and transport 10 are supported on support beam legs 25. These support beam legs are permanently affixed to the floor ensuring a permanent placement of the device. It should be specifically noted, however, that the support beam 5 and transport 10 may be supported in any conventional fashion from the roof or walls of the location such that the support beam 5 and transport 10 are level and permanently affixed in a single position.

In the preferred embodiment, four primary wrapping stations 30 are located at four distinct points along the length of support beam 5. An optional secondary wrapping station 35 or a plurality of such secondary wrapping stations 35 may be utilized to locate and secure palletized loads which are exceptional and must be loaded or transported by manual means. While the wrapping mechanism 1 is clearly adapted to wrap such a manually stacked and transported load, its primary function is to interface with the more automated feeding and assembly apparatus shown in FIG. 1. Each primary wrapping station 30 forms the terminus of the pallet assembly apparatus. The pallet assembly apparatus begins with primary feeder conveyors 40 of which two are shown for each wrapping station in FIG. 1. It is to be specifically noted that any number of primary feeder conveyors 40 may terminate in the vicinity of pallet assembly stations 50. In most applications, each primary feeder conveyor 40 brings a series of specific items to the pallet assembly station 50. The discrete goods to be stacked upon the pallet are transported along primary feeder conveyors 40 to pallet assembly station 50 which is generally a penned area. The pallets are sequentially stacked within pallet assembly station 50 and the goods from primary feeder conveyors 40 are stacked thereupon in a pre-selected pallet pattern. Assembly station gate 60 is generally closed during the stacking operation to facilitate the stacking of the pallet and to prevent disintegration of the load during stacking.

Once the load has been completely stacked on the pallet within pallet assembly station 50, assembly station gate 60 is swung open and the pallet is moved in a straight line along pallet conveyor 45. This is shown on the second pallet conveyor from the top as illustrated in FIG. 1, whereupon pallet 55 is located in an intermediate position along pallet conveyor 45. Provided that no pallet 55 is already located at the primary wrapping station 30, the pallet 55 is moved completely along the length of pallet conveyor 45 to primary wrapping station 30 as shown in all four of the wrapping stations illustrated in FIG. 1. As pallets 55 appear at primary wrapping stations 30, the operator selects the location according to his judgment of the priority assigned to the various stations. The operator then sends the transport mechanism 10 to the next highest priority primary wrapping station 30 in order to accomplish the wrapping of the pallet. When the transport 10 is inactive or in need of calibration, a home station 31 is provided at one end of support beam 5. The pallets 55 may then be removed from primary wrapping stations 30 or secondary wrapping station 35 through the use of a forklift or other conventional conveyor or transport means.

Figure 2:
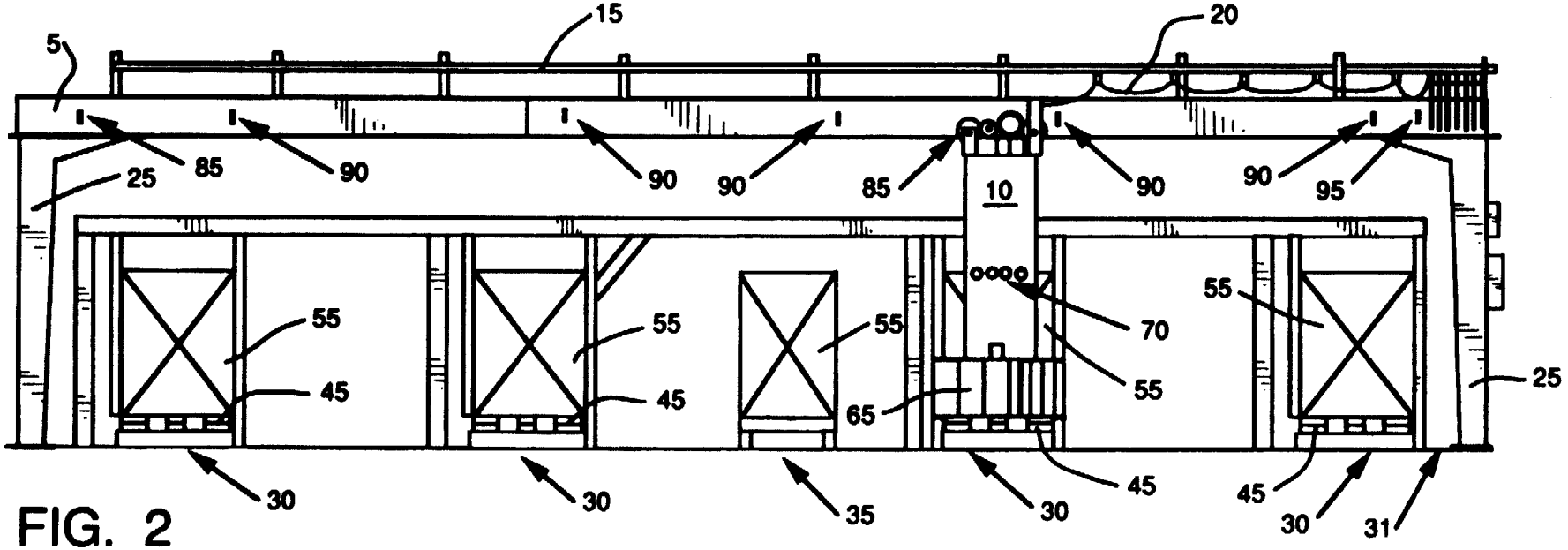
FIG. 2 is a side view of the device of FIG. 1 displaying a first embodiment of the swing arm mechanism.

Referring now to FIG. 2, the support beam 5 is shown supported on support beam leg 25 with communication line support rail 15 suspending communication line 20. Transport 10 is illustrated located in the second position from right, as shown in FIG. 2, in preparation of wrapping the pallet 55 located at the primary wrapping station 30 corresponding with that location. The four primary wrapping stations 30 are visible at the terminal points of pallet conveyors 45.

The transport 10 is shown having a transport location control panel 70 suspended from the transport motor and support assembly 80. Transport motor and support assembly 80 supports transport 10 from support beam 5 and provides the locomotive force and braking ability to move and hold transport 10 along support beam 5. Transport location control panel 70 is suspended therefrom and utilizes a series of simple electronic controls to locate transport 10 at pre-selected locations along support beam 5. In the preferred embodiment, a series of electronic pushbuttons, shown in FIG. 2, identify each of the primary and secondary wrapping stations 30 and 35, respectively, on a single electronic pushbutton. When the button is selected, the transport moves to that location, affixes itself in that location and begins to wrap the pallet that has been stationed there, after the operator has ascertained the proper location of the transport and initiates the wrapping process.

The transport 10 locates itself along support beam 5 utilizing station limit location indicators 90. A detector is positioned upon transport 10 and is utilized to seek station limit location indicators 90 to ascertain the location of transport 10. Any conventional locating mechanism may be utilized, such as electronic limit switches which are physically displaced by physical contact with the station limit location indicators 90 or a visual system utilizing a photo-detector and markings upon the beam.

In the preferred embodiment, three markings comprise the station limit location indicators 90 to allow the transport 10 to sense an upcoming station at a first encounter mark and to stop upon encountering the second or middle mark. The third mark is provided so that this detection sequence may be utilized when the transport 10 is moving in either direction. A home limit location indicator 95 is also provided, as well as an end of travel limit location indicator 85 for the respective location of transport 10 at the extremes of the home position and the end of travel location. This will prevent overextensive travel beyond the last primary wrapping station 30 at each end of support beam 5.

Figure 3:
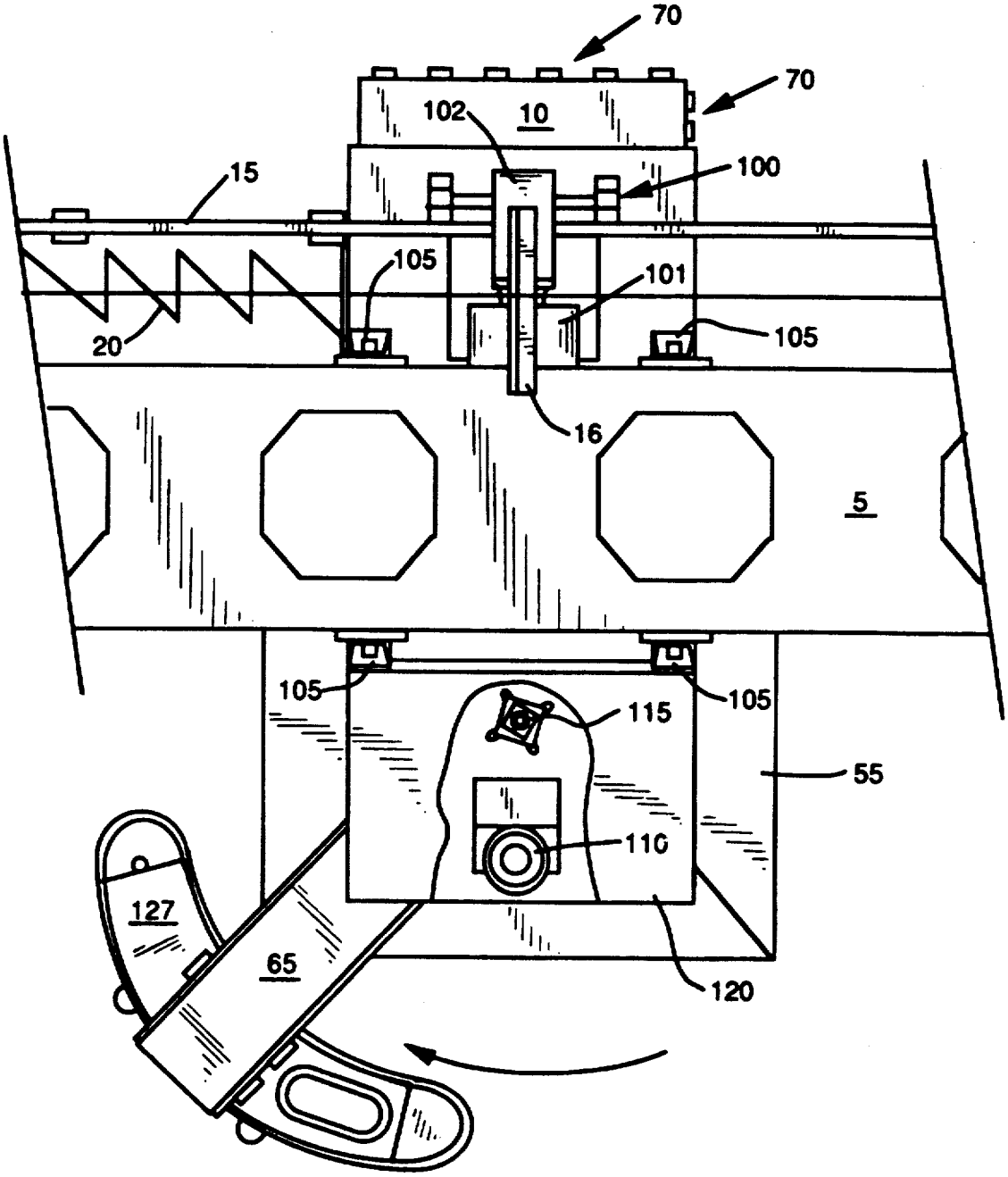
FIG. 3 is an enlarged view of the transport mechanism illustrating the first embodiment of the swing arm.

FIG. 3 illustrates an enlarged view of the transport mechanism 10 mounted on support beam 5. Support beam 5 has rail support member 16 extending therefrom, supporting communication line support rail 15. Communication line 20 extends along the length of support beam 5, providing electronic and/or fluid communication with transport 10. Transport 10 is illustrated positioned over a pallet 55 with swing arm 65 rotating in a clockwise fashion therearound according to the arrow. Wrapping carriage 127 is utilized to wrap the plastic about the pallet 55.

Transport 10 is moved longitudinally along support beam 5 on transport support wheels 105. Transport support wheels 105 are positioned to permit only longitudinal movement of the transport 10 along the support beam 5 and to prevent any rotational or torsional movement of the transport 10 during the wrapping function. As such, transport support wheels 105 are shaped and adapted to snugly encompass support beam 5 for minimum displacement therefrom. A transport drive mechanism 100 is illustrated at the top portion of transport 10. The transport drive mechanism is comprised of a transport drive wheel 101 which is in contact with support beam 5. Transport drive wheel 101 is rotatably placed by transport drive motor and gear reducer 102. Transport drive motor and gear reducer 102 are driven through electronic communications provided through communication line 20 and are ultimately controlled by transport location control panel 70. The positioning logic and control means contained within transport location control panel 70 are of a conventional nature and should be well known to those skilled in the electric motor art.

The swing arm 65 is pivotally connected to the lower portion of transport 10, which is not shown in FIG. 3, but described with reference to later Figures. Swing arm 65 is rotatably displaced by swing arm drive mechanism 110. Further detail regarding the rotational motion of swing arm 65 will be described later with references to FIGS. 4, 5 and 6. The electronic communication between communication line 20 and the electronic components of swing arm 65 are achieved through a slip contact 115 mounted at the pivot point of swing arm 65. The slip contact 115 permits rotational movement of swing arm 65 while maintaining continuous electrical contact with the stationary transport 10. This permits the swing arm 65 to continuously rotate without twisting or bending of electrical contact wires which would need to be extended from the stationary transport 10 to the rotational swing arm 65.

Figure 4:
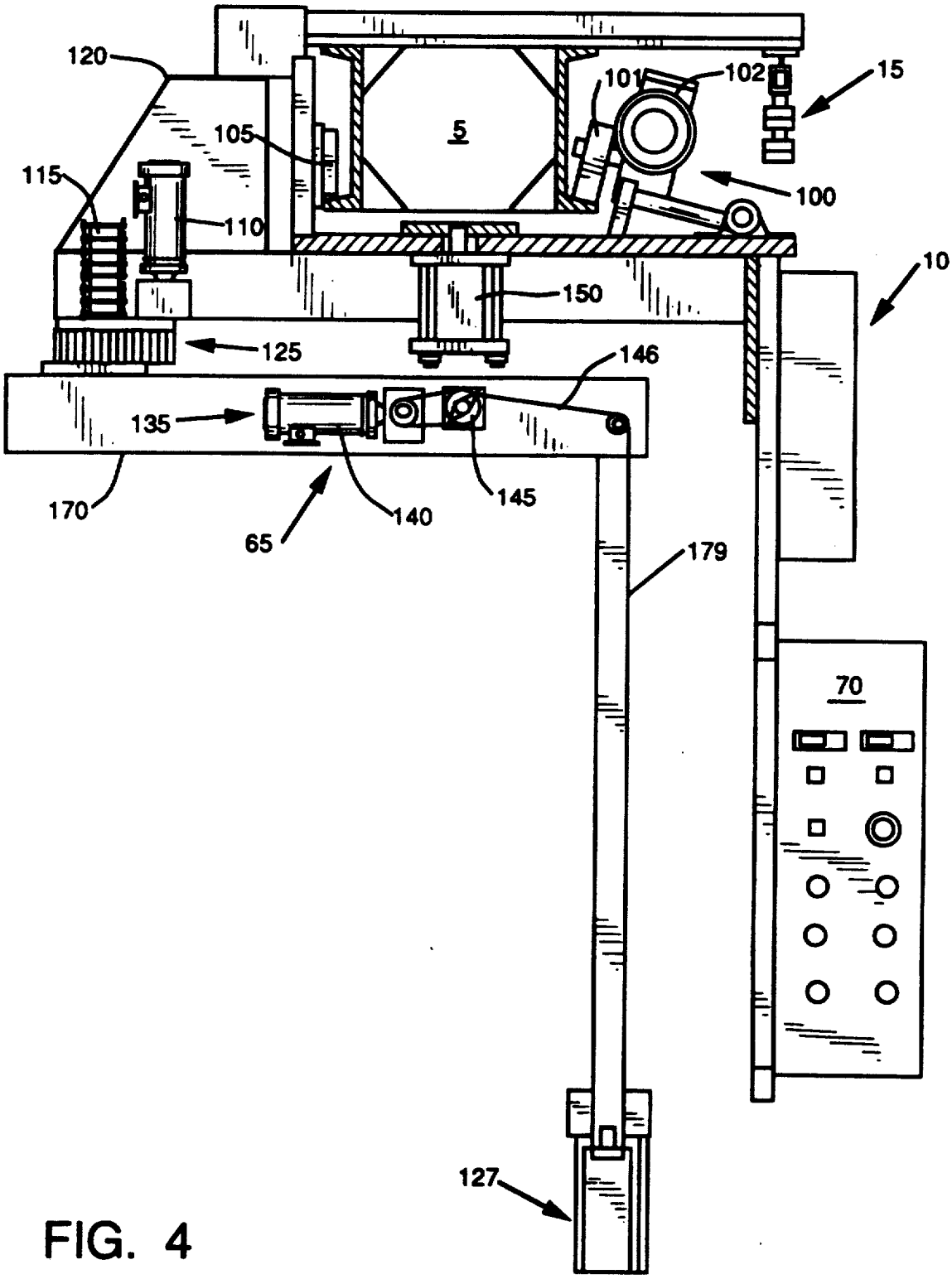
FIG. 4 is a lateral view, partially in section, of a second embodiment of the swing arm.

Referring now to FIG. 4, the second embodiment of the swing arm is illustrated in which the swing arm portion is a commercially available arm which has been adapted for use with this system. An example of such a commercially available swing arm is the Highlight Industries' Freedom 6000, manufactured by Highlight Industries, Inc., of Grandville, Mich. As previously illustrated, the transport mechanism 10 is mounted on support beam 5 through the use of transport support wheels 105. The transport drive mechanism 100 is shown having a transport drive wheel 101 in contact with support beam 5 and transport drive motor and gear reducer 102 which is utilized to drive transport drive 101 to longitudinally displace transport 10 along support beam 5. Communication line support rail 15 is shown mounted along the top portion of support beam 5. For the purposes of clarity, communication line 20 is not illustrated in FIG. 4. Transport drive mechanism 100 is pivotably mounted to the transport 10 to facilitate easy removal, servicing and adjustability relating to the amount of force required to be exerted on support beam 5.

The swing arm 65 is pivotably supported from the main housing of transport 10 and is rotated through the use of swing arm gear drive 125. Swing arm drive mechanism 110, mounted within the swing arm drive housing 120, is utilized to rotate swing arm gear drive 125 and permit rotational motion of swing arm 65 about the pivot. Slip contact 115 is centrally located within the pivoting portion of swing arm 65. A braking mechanism 150 is mounted within the main housing of transport 10 and is adapted to engage support beam 5 under both emergency and service conditions. While transport drive motor and gear reducer 102 may be fully adequate to provide the stopping and locating ability of the transport 10 along support beam 5, braking mechanism 150 may be utilized to more fully lock transport 10 at one of the wrapping locations described previously. Braking mechanism 150 may be of any conventional electronic or fluid-operated, frictional braking systems which are well-known in the art.

The swing arm 65 as provided by Highlight Industries, Inc., is generally described in product literature for the model Freedom 6000 a being constructed of structural steel tubing and utilizing a DC motor for the rotation of the arm. A standard programmable controller accompanies the swing arm mechanism. During the rotational movement of swing arm 65 about swing arm gear drive 125, horizontal support 170 is rotated within the plane formed by its length. Vertical support 175 thus cuts a hollow cylindrical path around the stacked pallet which is to be wrapped. The wrapping carriage 127 is vertically displaced along vertical support 175 during this circular movement about swing arm gear drive 125. With both circumferential and vertical displacement of the wrapping carriage 127, a helical wrapping pattern is produced on the stacked pallet. Electrical communication between transport 10 and wrapping carriage 127 is provided by an external electrical lead (not shown).

The wrapping carriage 127 is vertically displaced along the length of vertical support 175 through the use of wrapping carriage locator 135. Wrapping carriage locator 135 is comprised of wrapping carriage locator motor 140 which includes a gear reducer affixed to wrapping carriage locator spool 145. A flat belt 146 is affixed to the spool which connects the wrapping carriage 127 to wrapping carriage locator spool 145. Engagement of wrapping carriage locator motor 140 causes spool 145 to rotate, either taking up or extending belt 146. This permits the upward and downward vertical movement of wrapping carriage 127 along vertical support 175. The relative speed by which the wrapping carriage 127 is displaced along vertical support 175 with respect to the rotational speed of swing arm 65 about swing arm gear 125 controls the amount of overlap between the helically wrapped layers of stretch wrap about the stacked pallet.

Figure 5:
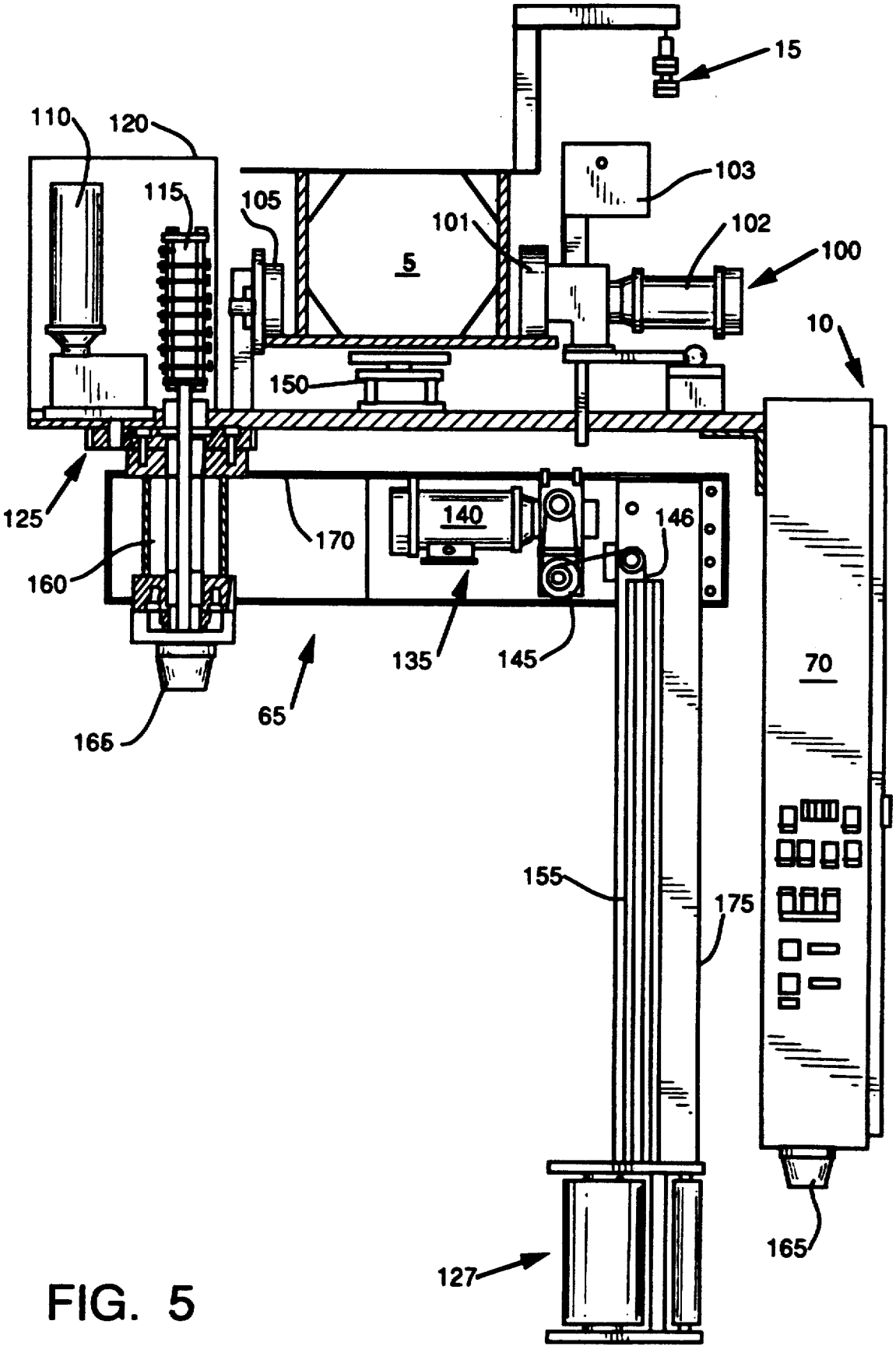
FIG. 5 is a lateral view, partially in section, of the first embodiment of the swing arm.

FIG. 5 illustrates the first embodiment of the swing arm in greater detail. It is to be specifically noted that each of the features of the first and second embodiments of the swing arm, aside from the actual structure and mounting of the arms, are interchangeable between the two embodiments. As previously described, the transport 10 is mounted upon support beam 5 by transport support wheels 105. Transport drive mechanism 100 is again comprised of transport drive motor and gear reducer 102 driving transport drive wheel 101 which is in contact with a surface of support beam 5. In this first embodiment, the transport drive motor and gear reducer 102 is mounted perpendicularly to its position in the second embodiment described previously. A transport limit locator device 103 is also located upon the platform housing the transport drive mechanism 100. Transport limit locator 103 may be comprised of any one of a number of limit switches or photoelectric locators to detect the position of transport 10 along support beam 5 through the identification of station limit location indicators 90 or home and end of travel limit location indicators 95 and 85, respectively. Communication line support rail 15 is illustrated, suspended a greater distance above the upper surface of support beam 5 to permit the positioning of transport limit locator 103 and transport drive mechanism 100 in this embodiment. As previously stated, communication line 20 is not shown for the purpose of clarity. As with the second embodiment described previously, this embodiment utilizes a pivoted platform to support the transport drive mechanism 100 to facilitate ease of service and adjustment of the drive mechanism. The adjustment of the drive mechanism includes setting the correct amount of loading force exerted by the transport drive wheel 101 on the surface of support beam 5. A braking mechanism 150 is again optionally provided to further secure transport 10 at a particular location along support beam 5 or to provide rapid stopping ability in the event that such a rapid stop is required. The first embodiment of support arm 65 utilizes a disc brake mechanism which may be fluid operated, according to well-known braking techniques. Transport 10 further includes a swing arm drive housing 120 which encloses the swing arm drive mechanism 110 and the slip contact 115. Swing arm drive mechanism 110 rotates swing arm gear drive 125 to achieve the rotation of swing arm 65 about swing arm bearing 160.

Figure 6:
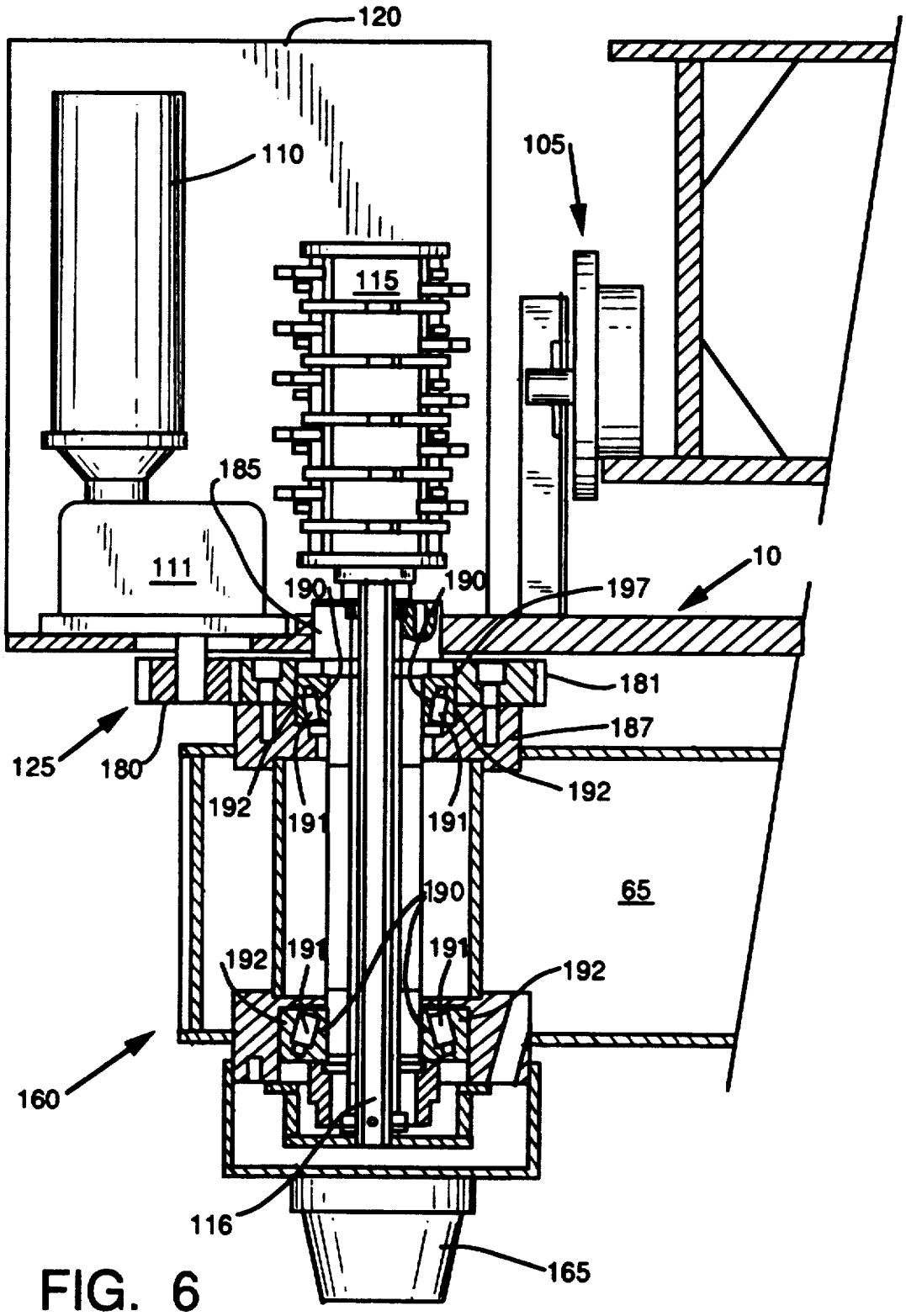
FIG. 6 is a sectional view of a portion of the second embodiment of the swing arm showing the bearing mechanism and slip contact in detail.

Swing arm bearing 160 will described in further detail with respect to FIG. 6. Analogous to the operation of the device described with reference to FIG. 4, the horizontal support of swing arm 65 rotates in a circular fashion about bearing 160. Vertical support 175 again cuts a hollow, cylindrical pattern in the space about the pallet allowing wrapping carriage 127 to be vertically displaced therealong to provide a helical wrapping pattern about the palletized material. Wrapping carriage locator 135 is relatively similar to that provided in the second embodiment comprising a wrapping carriage locator motor 140 and a wrapping carriage locator spool 145, which controls the movement of a belt 146 to raise and lower the carriage. The first embodiment of swing arm 65 is further provided with electrical rails 155 to provide electrical communication between vertical support 175 and wrapping carriage 127. This eliminates the need for electrical wire connections which were discussed but not shown in the previous Figure to electrically connect wrapping carriage 127 with the remainder of the device. The electrical rails are generally of a comb arrangement, having brushes mounted within the wrapping carriage 127 to provide a continuous electrical contact while wrapping carriage 127 is vertically displaced along vertical support 175. Warning lights 165 may be placed on any of the embodiments at any position to provide an indication that the device is in a movement or operative phase.

Referring now to FIG. 6, an enlarged view of the bearing and swing arm mechanisms is illustrated. The transport 10 is suspended from support beam 5 by transport support wheel 105. Transport 10 further comprises a swing arm drive housing 120 enclosing swing arm drive mechanism 110, swing arm gear reducer 111 and slip contact 115. Swing arm gear reducer 111 is utilized to rotate swing arm gear drive 125 to achieve the rotation of the swing arm 65 through the mating of the swing arm drive gear 180 and the driven gear assembly 181.

The swing arm bearing 160 is comprised of a central spindle 185 having a bearing shaft race at the top and bottom portion thereof to support bearings 191 which are preferably of the roller type. Bearings 191 are utilized to permit the rotational motion of the bearing sup assembly 192 thereabout permitting swing arm 65 to freely rotate about the bearing spindle 185. Bearing shaft race 190 and bearing 191 together form bearing cone assembly 197. Bearing cone assembly 197 is rotatably seated in and held captive by bearing cup assembly 192. The heavy-duty bearing 160 is specifically designed to permit the support of the grossly unbalanced swing arm 65 and permit rapid rotation of the unbalanced swing arm 65 about the central bearing spindle 185 by providing high radial and thrust load values. Driven gear assembly 181 is permanently affixed to the upper support flange 187 to permit transmission of the rotational force from driving 180 to the swing arm 65. The slip contact 115 further comprises a slip contact shaft 116 which permits the ingress and egress of electrical wires to the operative portion of slip contact 115.

Figure 7:
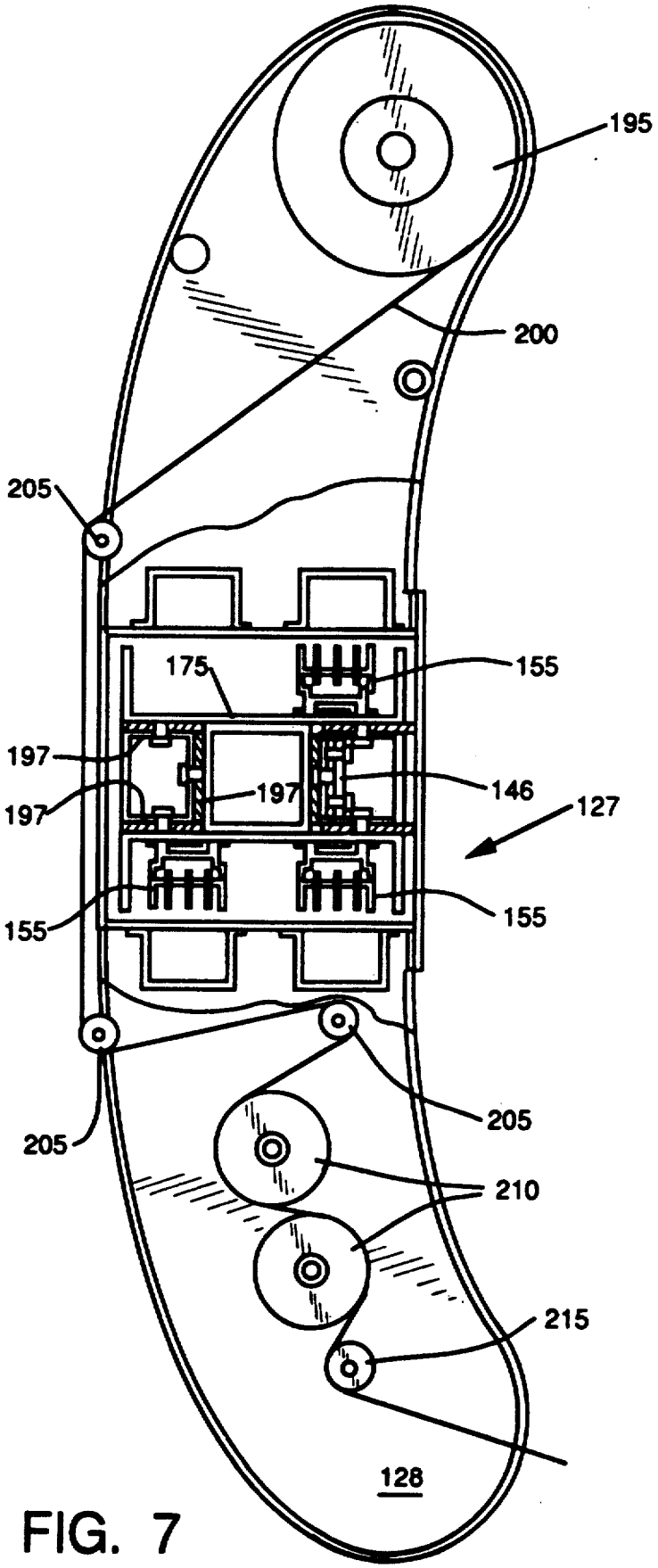
FIG. 7 is a sectional view of the wrapping carriage mechanism.

FIG. 7 illustrates the mechanical structure of the wrapping carriage 127. A housing having a support plate 128 at the bottom thereof is utilized to support a plastic wrap spool 195 which is sequentially threaded through a number of rollers to permit for pre-stretching of the material before its application to the package. The wrapping carriage 127 is mounted on vertical support 179 and is supported thereon by slide plates 197. Slide plates 197 are preferably formed of a ultra-high molecular weight plastic polymer. These replace the roller or cam bearings (not shown) utilized in the prior art swing arm described as the second embodiment herein. Electrical rails 155 are shown mounted to vertical support 175, although the brushes or contacts associated with the wrapping carriage have been eliminated for clarity. These would normally be interspersed between the "fingers" of the comb-like electrical rails 155.

The plastic wrap 200 is threaded through a series of guide rollers 205 about the vertical support 175. These guide rollers 205 define the pathway of the plastic 200 in various directions while maintaining the tension thereon. Two electric motors 210 are utilized to achieve the pre-stretch of the plastic wrap. These drum motors are well-known in the prior art and are exemplified by the Electric GV Drum Motors produced by Van der Graaf of DeWeijert, Holland. These drum motors are electrically driven and the speed by which the external surface turns is controlled electronically from a remote source. The two drum motors 210 may thus be turned independently by controlling the voltages applied thereto. By turning the second of the two drum motors at a speed faster than the first of the two drum motors, a differential is created between the speeds and the force exerted upon the plastic wrap 200. This creates a stretching arrangement as the plastic wrap 200 passes across the two electric drum motors 210, such that the plastic wrap is controllably stretched in a consistent manner.

Tension or dancer roller 215 is laterally displaceable over a small distance permitting a constant amount of tension to be exerted between the plastic wrap emerging from the electric drum motors 210 and extending to the stacked pallet. An inductive proximity switch (not shown) is utilized to detect displacement of the tension roller 215. Feedback from the proximity switch is utilized to detect film failure or termination. This further is utilized to shut off the device. The plastic wrap is manually drawn from the wrapping carriage 127 and tucked into a crevice of the stacked pallet, whereupon the operator engages the swing arm mechanism and the wrapping procedure begins. At the termination of the wrapping procedure the plastic wrap 200 is cut and the transport 10 moves to another location. The use of the two electric drum motors 210 permits increasing flexibility in the adjustment of the pre-stretch amount on plastic wrap 200. In conventional systems, including the second embodiment of the swing arm 65 described herein, the pre-stretch is mechanically fixed by the preset set-up of the swing arm mechanism. Some systems include a hydraulic system by which the amount of pre-stretch may be adjusted to some degree. The application of electric drum motors permits a feed-back circuit to be utilized in which the pre-stretch for a given station may be pre-selected and pre-programmed within the controls of the device. This arrangement allows a continuous stretch to be applied to the film based on the rotational speed of the turning swing arm.

A mechanical connection between the two stretch rollers merely mechanically applies a differential stretch. The device discussed herein alters the relative speed differential between the two electric drive motors according to the rotational speed of the swing arm. As the swing arm increases in speed, the pre-stretching of the film may be lessened to maintain a constant stretch value for the plastic wrap as actually applied. This takes advantage of the increasing stretch applied to the wrap between the swing arm and the palletized material as it is applied at higher speeds. Thus, the plastic wrap is applied having a constant pre-stretch value as well as a constant force on the palletized load itself. Additionally, the device permits the force on the load to be selected for each wrapping station individually. This allows different types of loads to be wrapped at the different wrapping stations simultaneously.

While a present preferred embodiment of the invention is described, it is to be distinctly understood that the invention is not limited thereto but may be otherwise embodied and practiced within the scope of the following claims.

What is claimed is:

1. An apparatus for affixing a plastic wrap to the exterior surface of a plurality of palletized stacks of boxes, comprising:

a) a support beam rigidly fixed and suspended a preselected distance from the ground and having a plurality of wrapping stations located therealong;

b) motorized transport means displaceably mounted on said support beam such that said motorized transport means is capable of longitudinal displacement from one to another of said wrapping stations, along the length of said support beam;

c) a swing arm, having a horizontal member and a vertical member mounted at one end thereof, rotatably mounted at the other end of said horizontal member to said motorized transport means, adapted such that said vertical member describes a circular path encircling a palletized stack of boxes placed within said circular path; and d) wrapping carriage means adapted to contain and dispense a length of plastic wrap, slidingly affixed to said vertical member, permitting vertical displacement therealong;

wherein a plurality of palletized stacks of boxes located at said wrapping stations are each sequentially wrapped in said length of plastic wrap dispensed from said wrapping carriage as said wrapping carriage is circularly and vertically displaced in a circular path about each of said palletized stacks of boxes.

2. An apparatus as described in claim 1, wherein said motorized transport means is controlled remotely.

3. An apparatus as described in claim 2, wherein the motorized transport means is displaced to one of several wrapping stations by depression of a single control.

4. An apparatus as described in claim 1, wherein said apparatus forms the termination of a pallet loading and creation system.

5. An apparatus as described in claim 4, wherein at least one wrapping station is located at the termination of a pallet transportation conveyor.

6. An apparatus as described in claim 5, further comprising an additional wrapping station at which the palletized stack to be wrapped is manually assembled and transported.

7. An apparatus as described in claim 1, further comprising communication means extending from an outside source to said motorized transport means.

8. An apparatus as described in claim 7, wherein said communication means extend along the length of said support beam.

9. An apparatus as described in claim 8, wherein said communication means comprise at least one of electric cable and fluid conduit.

10. An apparatus as described in claim 1, wherein said motorized transport means further comprises transport drive means and control means.

11. An apparatus as described in claim 10, wherein said transport drive means comprises motor means, gear reduction means and drive wheel means.

12. An apparatus as described in claim 11, wherein said drive wheel means is in contact with said support beam and rotation thereof displaces said motorized transport means longitudinally along the length of said support beam.

13. An apparatus as described in claim 1, wherein said support beam further comprises at least one location marker along its length, said location marker corresponding to at least one of said wrapping stations.

14. An apparatus as described in claim 13, wherein each of said wrapping stations has a corresponding location marker located on said support beam.

15. An apparatus as described in claim 14, wherein said location marker is utilized by said motorized transport means to fix its location and stop at a predetermined wrapping station.

16. An apparatus as described in claim 15, wherein said motorized transport means further comprises detection means for ascertaining the presence of one of said location markers and halting the motion of said motorized transport means at said predetermined wrapping station.

17. An apparatus as described in claim 1, wherein said motorized transport mechanism is supported on said support beam by a plurality of wheels, said wheels shaped and adapted to snugly grip said support beam to reduce displacement of said motorized transport means when said motorized transport means is in a fixed position.

18. An apparatus as described in claim 1, wherein said motorized transport means further comprises a braking apparatus for fixing said motorized transport means in a fixed position with relation to said support beam.

19. An apparatus as described in claim 1, wherein said swing arm further comprises swing arm drive means, mounted within said motorized transport means, for rotating said swing arm in a circular path.

20. An apparatus as described in claim 19, wherein said swing arm further comprises a slip contact for maintaining a plurality of electrical contacts while said swing arm is rotatably displaced.

21. An apparatus as described in claim 1, wherein said swing arm further comprises wrapping carriage locator means for vertically displacing said wrapping carriage along said vertical member.

22. An apparatus as described in claim 21, wherein said swing arm further comprises at least one electrical rail extending along the length of said vertical member and said wrapping carriage further comprises at least one electrical contact engaging said electrical rail, such that said electrical contact continuously engages said electrical rail when said wrapping carriage is vertically displaced along said vertical member.

23. An apparatus as described in claim 22, wherein said swing arm further comprises a high strength bearing joining said swing arm to said motorized transport means, said high strength bearing permitting the rotation of said swing arm with relation to said motorized transport means.

24. An apparatus as described in claim 23, wherein said high strength bearing further comprises:

a central spindle;

an upper and lower bearing cone assembly mounted at each end of said central spindle, having a bearing race portion and bearing portion mounted at an angle with respect to said central spindle; and upper and lower bearing cups, supporting said swing arm, mounted adjacent said bearing cone assemblies and rotatably seated thereon.

25. An apparatus as described in claim 1, wherein said wrapping carriage is comprised of a spool means for storing and dispensing a length of plastic wrap.

26. An apparatus as described in claim 25, wherein said wrapping carriage further comprises two cylindrical speed adjustable motors.

27. An apparatus as described in claim 26, wherein said plastic wrap passes between said cylindrical speed adjustable motors wherein when said cylindrical speed adjustable motors are rotated at different speeds, said plastic wrap is stretched therebetween.

28. An apparatus as described in claim 27, wherein said speeds of said cylindrical speed adjustable motors are adjusted according to preset calibrations.

29. An apparatus as described in claim 28, wherein said preset calibrations vary according to the wrapping station at which said motorized transport means is located.

30. An apparatus as described in claim 27, wherein said speeds of said cylindrical speed adjustable motors are adjusted according to the rotational speed of said swing arm.

31. An apparatus as described in claim 30 wherein said speeds of said cylindrical speed adjustable motors is adjusted to achieve a consistent force of said plastic wrap on said palletized stacks of boxes.

32. An apparatus as described in claim 25, wherein said wrapping carriage is supported on said vertical member by a series of rollers.

33. An apparatus as described in claim 25, wherein said wrapping carriage is slidably supported on said vertical member by a series of polymer blocks.

34. An apparatus for palletizing a plurality of boxes on a plurality of pallets and affixing a plastic wrap to the exterior surface of a resulting plurality of palletized stacks of boxes, the apparatus comprising:

a) a plurality of feed conveyors having termination points;

b) a plurality of pallet assembly pens, each located adjacent the termination point of at least one feed conveyor;

c) a single pallet conveyor extending from each assembly pen, each pallet conveyor terminating in a wrapping station;

e) a support beam rigidly fixed and suspended a preselected distance from the ground above said wrapping stations and having a plurality of stop locations located thereon corresponding to said wrapping stations;

f) motorized transport means displaceably mounted on said support beam such that said motorized transport means is capable of longitudinal displacement from one to another of said wrapping stations, along the length of said support beam;

g) a swing arm, having a horizontal member and a vertical member mounted at one end thereof, rotatably mounted at the other end of said horizontal member to said motorized transport means, adapted such that said vertical member describes a circular path encircling a palletized stack of boxes placed at a wrapping station within said circular path; and h) wrapping carriage means adapted to contain and dispense a length of plastic wrap, slidingly affixed to said vertical member, permitting vertical displacement therealong; wherein a plurality of individual boxes are fed down said feed conveyors to said pallet assembly pens; said individual boxes being assembled into palletized stacks of boxes and transported along said pallet conveyors to said wrapping stations; said motorized transport means adapted to travel sequentially from one wrapping station to another, such that palletized stacks of boxes located at said wrapping stations are each sequentially wrapped in said length of plastic wrap dispensed from said wrapping carriage as said wrapping carriage is circularly and vertically displaced in a circular path about each of said palletized stacks of boxes.

* * * * *

UNITED STATES PATENT AND TRADEMARK OFFICE

CERTIFICATE OF CORRECTION

PATENT NO. : 5,140,795

DATED : August 25, 1992

INVENTOR(S) : Kurt L. Steding

It is certified that error appears in the above-identified patent and that said Letters Patent is hereby corrected as shown below:

Column 1, line 25, delete the first occurrence of the word "may".

Column 1, line 29, after "pallet" insert -- . --.

Column 2, line 36, delete "including" and insert -- includes --.

Column 2, line 57, delete "provide" and insert -- providing --.

Column 8, line 5, "a" should be -- as --.

Column 9, line 19, after "will" insert -- be --.

Column 9, line 62, delete "sup" and insert -- sub --.

In the claims:

Column 14, line 19, "e)" should be -- d) --.

Column 14, line 24, "f)" should be -- e) --.

Column 14, line 29, "g)" should be -- f) --.

UNITED STATES PATENT AND TRADEMARK OFFICE

CERTIFICATE OF CORRECTION

PATENT NO. : 5,140,795

DATED : August 25, 1992

INVENTOR(S) : Kurt L. Steding

It is certified that error appears in the above-indentified patent and that said Letters Patent is hereby corrected as shown below:

Column 14, line 37, "h)" should be -- g) --.

Signed and Sealed this

Second Day of November, 1993

*Attest:*

Bruce Lehman

BRUCE LEHMAN

*Attesting Officer*

*Commissioner of Patents and Trademarks*